US006102269A

United States Patent [19]

Elliott et al.

[11] Patent Number: 6,102,269

[45] Date of Patent: Aug. 15, 2000

[54] TOWEL DISPENSER WITH METERING MECHANISM

[75] Inventors: Adam Troy Elliott, Lexington, Ky.; Ricardo M. Parales, Loveland, Ohio

[73] Assignee: Bay West Paper Corporation, Harrodsburg, Ky.

[21] Appl. No.: 09/336,977

[22] Filed: Jun. 21, 1999

[51] Int. Cl.[7] ..... B65H 20/00

[52] U.S. Cl. ..... 226/130; 242/564.2

[58] Field of Search ..... 242/564.2, 565; 226/130, 148, 129

[56] References Cited

U.S. PATENT DOCUMENTS

| | | |
|---|---|---|
| Re. 20,333 | 4/1937 | Perrin . |
| 2,105,928 | 1/1938 | Perrin . |
| 2,175,141 | 10/1939 | Wooster . |
| 2,181,826 | 11/1939 | Wooster . |
| 2,622,873 | 12/1952 | Wenneche . |
| 2,839,345 | 6/1958 | Engel et al. . |
| 2,930,664 | 3/1960 | Liebisch . |
| 2,946,587 | 7/1960 | Ryno . |
| 3,010,338 | 11/1961 | Layton . |
| 3,017,131 | 1/1962 | Wooster . |
| 3,045,885 | 7/1962 | Dahlin et al. . |
| 3,140,060 | 7/1964 | Layton et al. . |
| 4,165,138 | 8/1979 | Hedge et al. . |
| 4,664,304 | 5/1987 | Wendt et al. . |
| 4,699,304 | 10/1987 | Voss et al. . |
| 4,732,306 | 3/1988 | Jesperson . |

*Primary Examiner*—Donald P. Walsh
*Assistant Examiner*—Collin A. Webb
*Attorney, Agent, or Firm*—Merchant & Gould P.C.

[57] ABSTRACT

A towel dispenser, such as a paper towel dispenser, having a metering mechanism for preventing excessive towel dispensing. The dispenser includes a housing, a dispensing mechanism associated with the housing for dispensing towel stored within the housing, and a metering mechanism associated with the housing for metering a length of towel dispensed from the housing. The metering mechanism includes a metering bar that is slideably disposed within the housing and that is selectively engageable with the dispensing mechanism for controlling actuation of the dispensing mechanism. The metering mechanism also includes an actuation button that is accessible from outside the housing and that is connected to the metering bar for actuating the metering bar. The actuation button is moveable in a direction that is opposite the direction of movement of the metering bar. The metering mechanism of the invention is more tamper resistant to prevent damage thereto and to the elements of a dispensing mechanism of the towel dispenser. Further, the dispenser is more ergonomic in design.

17 Claims, 8 Drawing Sheets

TOWEL DISPENSER WITH METERING MECHANISM

FIELD OF THE INVENTION

This invention relates to towel dispensers that dispense towel, such as paper towel and the like. In particular, the invention relates to a towel dispenser having a metering mechanism associated therewith to prevent dispensing of an excessive amount of towel therefrom. The invention is particularly useful for paper towel dispensers in order to prevent excessive use of paper towel and thereby avoid paper waste.

BACKGROUND OF THE INVENTION

Roll paper towel dispensers are well known. They are most commonly found in and around lavatories, bathrooms, wash sinks and the like to enable users to dry their hands and other body parts after washing. Paper towel dispensers are typically mounted onto a wall to permit user access thereto, with the dispensers being manually actuated by the user to dispense a desired length of paper towel from a paper towel roll. One drawback of many conventional paper towel dispensers is that users are allowed to freely dispense as much of the paper as they would like, which in most instances leads to excessive use of paper towel and thus paper waste.

There have been many attempts in the prior art to devise paper towel dispensers that prevent excessive dispensing of paper towel therefrom. These attempts involve the use of metering mechanisms which provide an impediment to continuous paper dispensing, typically by requiring the user to perform a certain act or wait for a period of time after a certain amount of paper towel has been dispensed before any further dispensing can continue. The extra act and/or time required by such metering mechanisms provide an impediment to excessive paper towel dispensing.

An example of a conventional paper towel dispenser having a metering mechanism is disclosed in U.S. No. Pat. 4,664,304 to Wendt et al. This patent describes a metering mechanism 64 having a button 69 that must be manually pressed by a user each time to enable a predetermined amount of paper towel to be dispensed. The button 69 is connected to a body 70 which is forced backward upon pressing the button inward so as to temporarily disengage the metering mechanism 64 and permit dispense of a predetermined length of paper towel. The button 69 projects from the front of the dispenser adjacent the bottom thereof, and is located adjacent the bottom stroke of an actuating rack 46 and handle 47 forming part of a drive mechanism to cause dispensing of paper towel. It has been found that this construction is susceptible to tampering and damage by smashing the button 69 and the body 70 connected thereto into the dispenser housing. Since the button and body are linked to the gears of the drive mechanism, the gears often times break, thereby rendering the dispenser inoperative. Furthermore, the Wendt et al. dispenser is awkward to operate, requiring a user to push in the button adjacent the base of the dispenser, and then reach to a different location on the dispenser to actuate the dispensing mechanism to dispense paper.

Therefore a need exists for an improved paper towel dispenser or the like and associated metering mechanism that is more tamper resistant to prevent intentional damage thereto. Furthermore, a need exists for a paper towel dispenser or the like and associated metering mechanism that is more ergonomic with respect to the design of the dispensing mechanism and the metering mechanism to permit more convenient and natural operation thereof A need also exists for a paper towel dispenser or the like and associated metering mechanism, in which the dispensing mechanism and metering mechanism are simple in design, thereby facilitating manufacture and construction of the dispenser, as well as making maintenance and repair work on the dispenser easier.

SUMMARY OF THE INVENTION

The invention provides an improved towel dispenser and metering mechanism used therewith that prevents excessive amounts of towel from being dispensed. Preferably, the dispenser is a paper towel dispenser that dispenses paper towel therefrom. However, the invention could be used with other forms of towel as well, such as cloth or fabric towel. The metering mechanism is designed to be tamper resistant to prevent damage thereto and to the elements of a dispensing mechanism of the towel dispenser. Further, the metering mechanism and the dispensing mechanism are specially designed to render the towel dispenser more ergonomic, thereby permitting more convenient and natural operation thereof. Further, the metering mechanism and the dispensing mechanism are simple in design and have a reduced number of parts compared to conventional towel dispensers, thereby facilitating manufacture and construction of the dispenser, as well as making maintenance and repair work on the dispenser easier.

In one embodiment in accordance with the invention, a towel dispenser is provided. The dispenser includes a housing, a dispensing mechanism associated with the housing for dispensing towel stored within the housing, and a metering mechanism associated with the housing for metering a length of towel dispensed from the housing. The metering mechanism includes a metering bar that is slideably disposed within the housing and that is selectively engageable with the dispensing mechanism for controlling actuation of the dispensing mechanism. The metering mechanism also includes an actuation button that is accessible from outside the housing and that is connected to the metering bar for actuating the metering bar. The actuation button is moveable in a direction that is opposite the direction of movement of the metering bar.

In yet another embodiment of the invention, a towel dispenser is provided which comprises a housing, dispensing means for dispensing towel stored within the housing, and metering means for metering a length of towel dispensed from the housing. The metering means includes metering bar means for controlling actuation of the dispensing means, actuation means for actuating the metering bar means, and means interconnecting the metering bar means and the actuation means for causing the metering bar means to move in a direction that is opposite a direction of movement of the actuation means.

In still another embodiment of the invention, a towel dispenser is provided which comprises a housing, a dispensing mechanism associated with the housing, where the dispensing mechanism is constructed to dispense towel stored within the housing, and a metering mechanism associated with the housing. The metering mechanism is constructed to meter a length of towel dispensed from the housing, and the metering mechanism includes a metering bar that is slideably supported by the housing for movement relative thereto and is selectively engageable with the dispensing mechanism to control actuation of the dispensing mechanism, an actuation button, and a link pivotally supported by the housing and interconnecting the metering bar and the actuation button.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
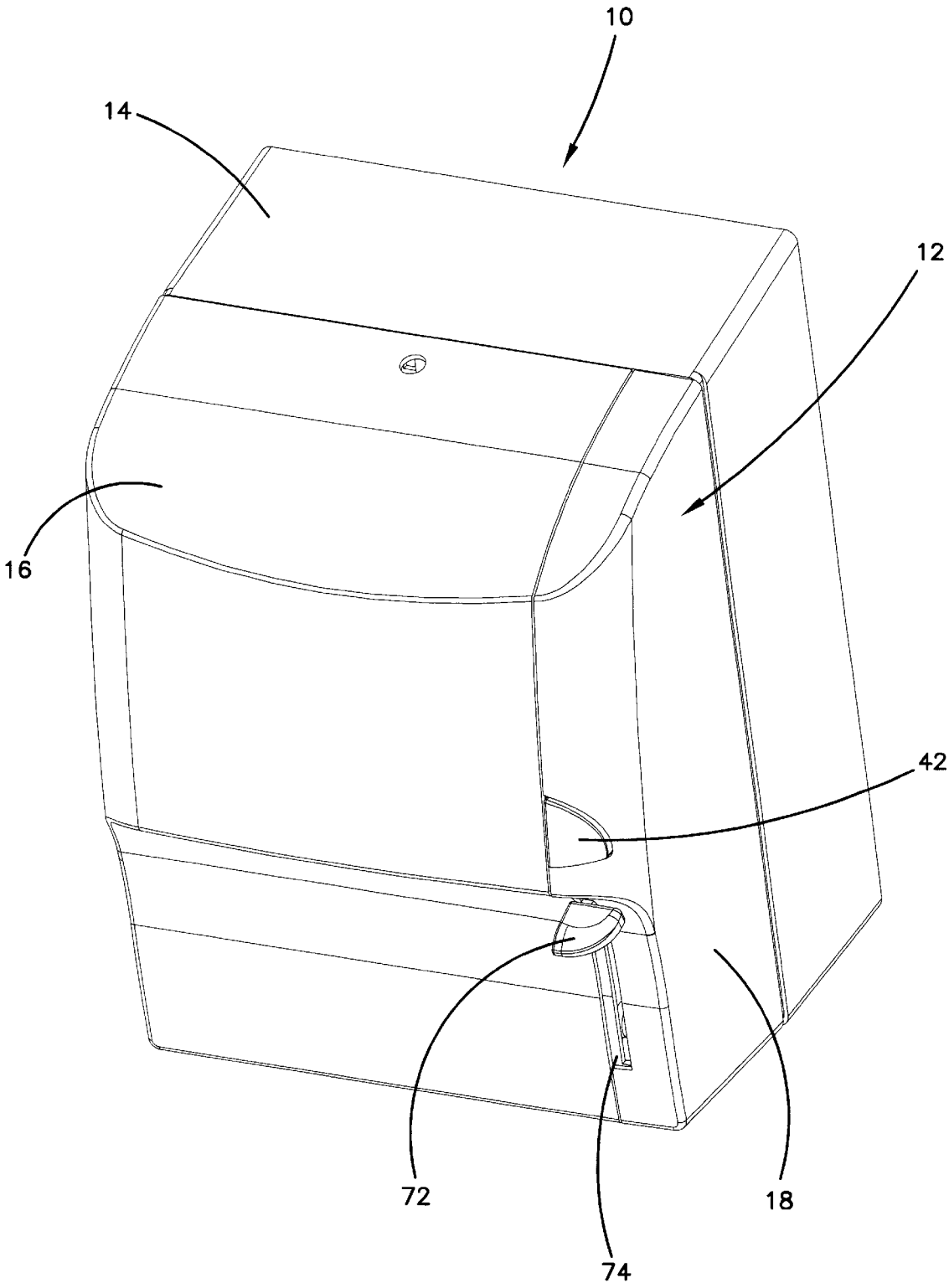
FIG. 1 is an upper, right-side perspective view of the towel dispenser in accordance with the invention.

One implementation of a towel dispenser constructed in accordance with the principles of the invention is illustrated in FIGS. 1–8, with the towel dispenser being referenced by the numeral 10. As shown in FIG. 1, the dispenser 10 includes a housing 12 that is formed from materials that are conventionally used to construct dispenser housings, such as plastic, metal and the like. The housing 12, which is of generally conventional construction, is formed of a rear housing portion 14 having top and bottom panels, side panels and a rear panel, a front housing portion 16 pivotally connected to the rear housing portion 14 to permit access to the interior of the housing 12, and a side housing portion 18 which is designed to house components associated with the operation of the dispenser 10. The front housing portion 16 is separated from the side housing portion 18, with the front housing portion 16 pivoting between open and closed positions to control access to the interior of the housing 12, and with the side housing portion 18 remaining fixed whereby it does not pivot with the front housing portion 16.

The rear housing portion 14, front housing portion 16 and side housing portion 18 define an interior cavity which contains one or more towel roll support mechanisms for supporting one or more towel rolls within the housing 12 for subsequent dispensing of towel from the dispenser 10. Preferably, the towel roll(s) is a paper towel roll, although other kinds of towel rolls, such as cloth or fabric towel rolls, could be used as well. For purposes of this description, the dispenser 10 will be described as dispensing paper towel.

The rear panel of the rear housing portion is provided with mounting apparatus to allow the dispenser 10 to be mounted on a wall in and around lavatories, bathrooms, wash sinks and the like. The overall construction of the housing 12 is not pertinent to the invention, and the specific details thereof, as well as the details of paper towel roll support mechanism(s) and mounting apparatus, need not be further described. For further details, reference should be made to the aforementioned U.S. Pat. No. 4,664,304, the disclosure of which is hereby incorporated by reference.

Figure 2B:
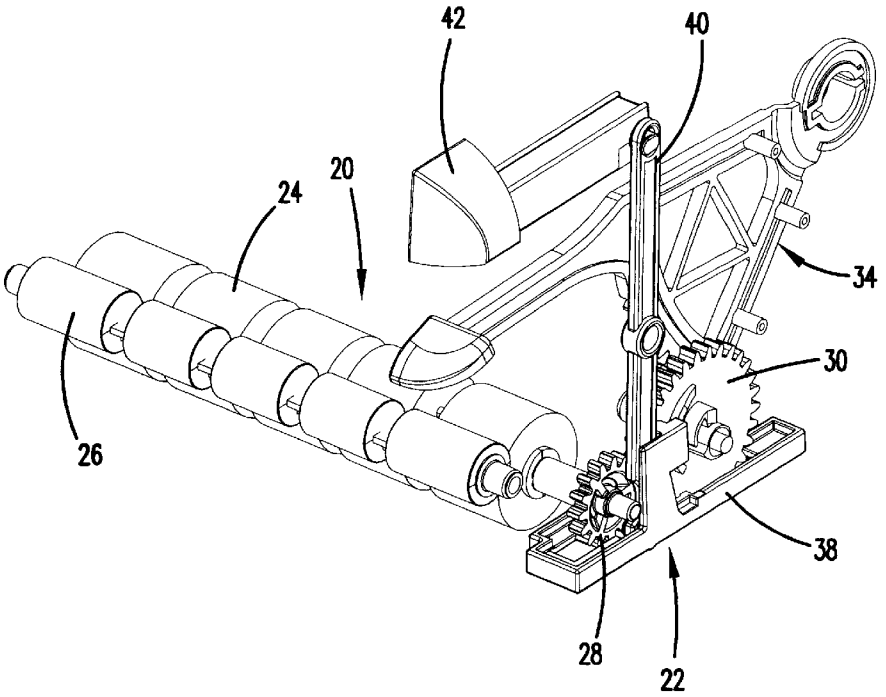
FIGS. 2A and 2B are perspective views of the dispensing mechanism and the metering mechanism used in the towel dispenser, with the dispenser housing removed for clarity.
Figure 2A:
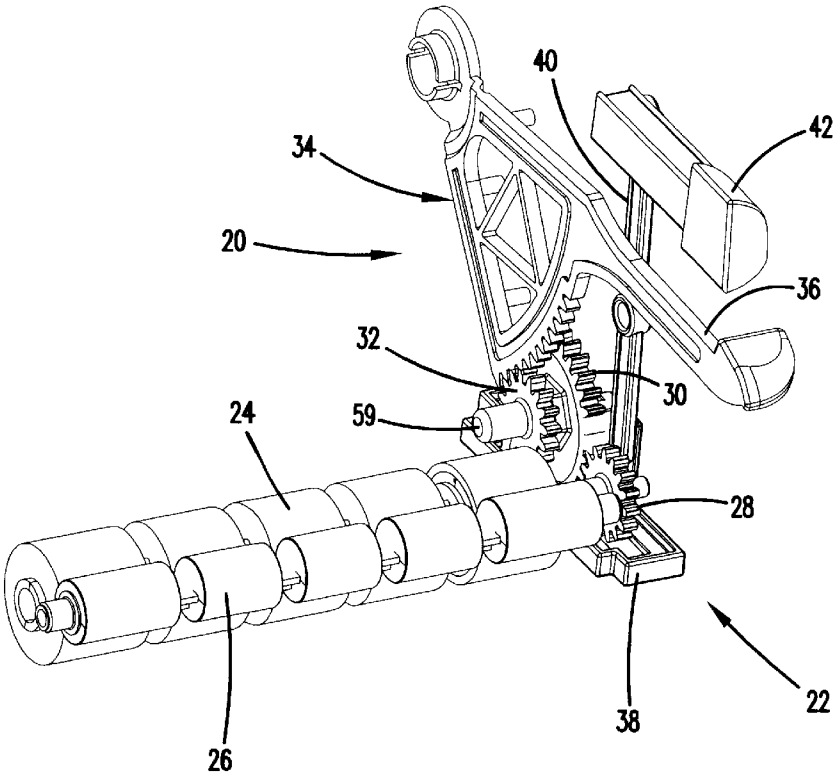
Figure 3:
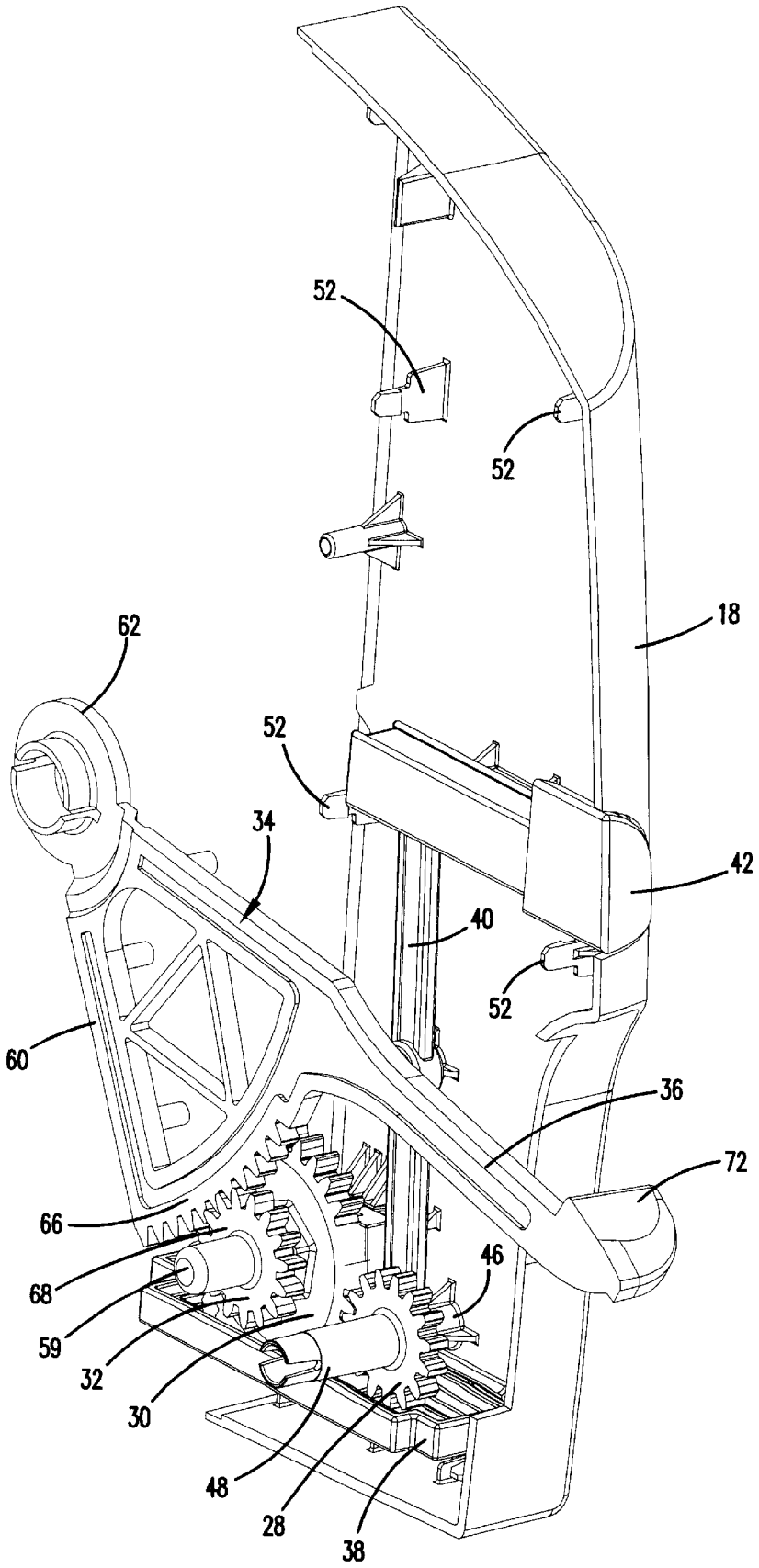
FIG. 3 is a left-side perspective view of the dispensing mechanism and the metering mechanism in relation to a portion of the dispenser housing, with the metering mechanism being disengaged to permit towel dispense.

Turning now to FIGS. 2A and 2B, a dispensing mechanism 20 and a metering mechanism 22 of the dispenser 10 are shown. The dispensing mechanism 20 and metering mechanism 22 are, for the most part, disposed within the housing 12, except for two elements that will be later described. However, to clarify the description and arrangement of the mechanisms 20, 22, the housing 12 is not shown in FIGS. 2A and 2B. The relationship of each mechanism 20, 22 relative to the housing 12 will become apparent from the description of FIGS. 3–8.

Specifically, the dispensing mechanism 20 includes a drive roll 24 and an idler roll 26 that are supported within the interior space of the housing 12 in a manner that is known in the art. The drive roll 24 and idler roll 26 form a nip therebetween through which a web (not shown) from the paper roll mounted within the housing 12 enters to be frictionally engaged by the drive roll 24. When the drive roll 24 is rotatably driven, the web is pulled from the paper roll through the nip with the leading edge thereof being discharged through a slot provided in the bottom of the housing 12. The details of the mounting and operation of the drive roll 24 and idler roll 26 are conventional in the art and are not essential to an understanding of the present invention, and are thus not further described. For further details, reference can be made to the aforementioned U.S. Pat. No. 4,664,304.

With reference to FIGS. 2A and 2B, as well as FIGS. 3–6, it is seen that a drive pinion 28 is connected to the end of the drive roll 24 to cause rotation of the drive roll upon rotation of the drive pinion. The drive pinion 28 is driven by a dispensing gear 30 that, in turn, is driven by a drive gear 32. A pivotally mounted, arcuate gear segment 34 is engaged with the drive gear 32 to cause rotation thereof, and a dispensing lever 36 is connected to the gear segment 34 to cause actuation of the segment 34. The dispensing mechanism 20 is designed to dispense paper towel from the paper towel roll upon actuation of the dispensing lever 36, through the interaction of the gear segment 34, the drive gear 32, the dispensing gear 30, the drive pinion 28, and the drive and idler rolls 24, 26.

The metering mechanism 22, on the other hand, includes a metering bar 38, and a link 40 connected at one end thereof to the metering bar 38 and connected at the opposite end thereof to an actuation button 42 to enable actuation of the metering bar 38. The metering mechanism 22 is designed to interact with the dispensing mechanism 20 to control the operation thereof and thereby meter the amount of paper towel that is dispensed from the dispenser 10. More specifically, the metering bar 38 is designed to selectively engage the dispensing gear 30, as will be described more fully below, to limit the rotation of the dispensing gear 30 to a predetermined number of actuations of the dispensing lever 36, with further rotation of the dispensing gear 30 being permitted only upon another actuation of the button 42 of the metering mechanism 22. Preferably, the dispensing mechanism 20 and the metering mechanism 22 are designed to permit one revolution of the dispensing gear 30 for every two actuations of the lever 36, whereby a user is able to actuate the lever 36 twice each time that the button 42 is actuated.

Specific details of the dispensing and metering mechanisms 20, 22 are illustrated more completely in FIGS. 3–6. It is seen that the drive pinion 28 includes an integral stub shaft 44 projecting from one side thereof that is rotatably supported within a sleeve 46 disposed on the interior surface of the side housing portion 18. The opposite side of the pinion 28 includes a sleeve 48 connected thereto that is in suitable driving engagement with the drive roll 24.

With continued reference to FIGS. 3–6, the sleeve 48 freely extends through a hole (not shown) provided in an interior panel 50 that is disposed within the housing 12 and which cooperates with the side housing portion 18 to generally enclose the drive pinion 28, the dispensing gear 30, drive gear 32, arcuate gear segment 34, dispensing lever 36, metering bar 38, link 40 and button 42 whereby these elements are separated from the interior space of the housing 12. The side housing portion 18 is preferably provided with a plurality tabs 52 projecting therefrom that fit into corresponding posts 54 provided on the panel 50 whereby the panel 50 and the side housing portion 18 are removably connected together to enable access to the components of the dispensing and metering mechanisms 20, 22.

The drive gear 32 and dispensing gear 30 arrangement is designed to enable the drive gear 32 and dispensing gear 30 to rotate together during a dispensing stroke of the dispensing lever 36, and to enable the drive gear 32 to rotate by itself while the dispensing gear 30 remains stationary during a return stroke of the dispensing lever 36, whereby only one way rotation of the dispensing gear 30 occurs.

Figure 6:
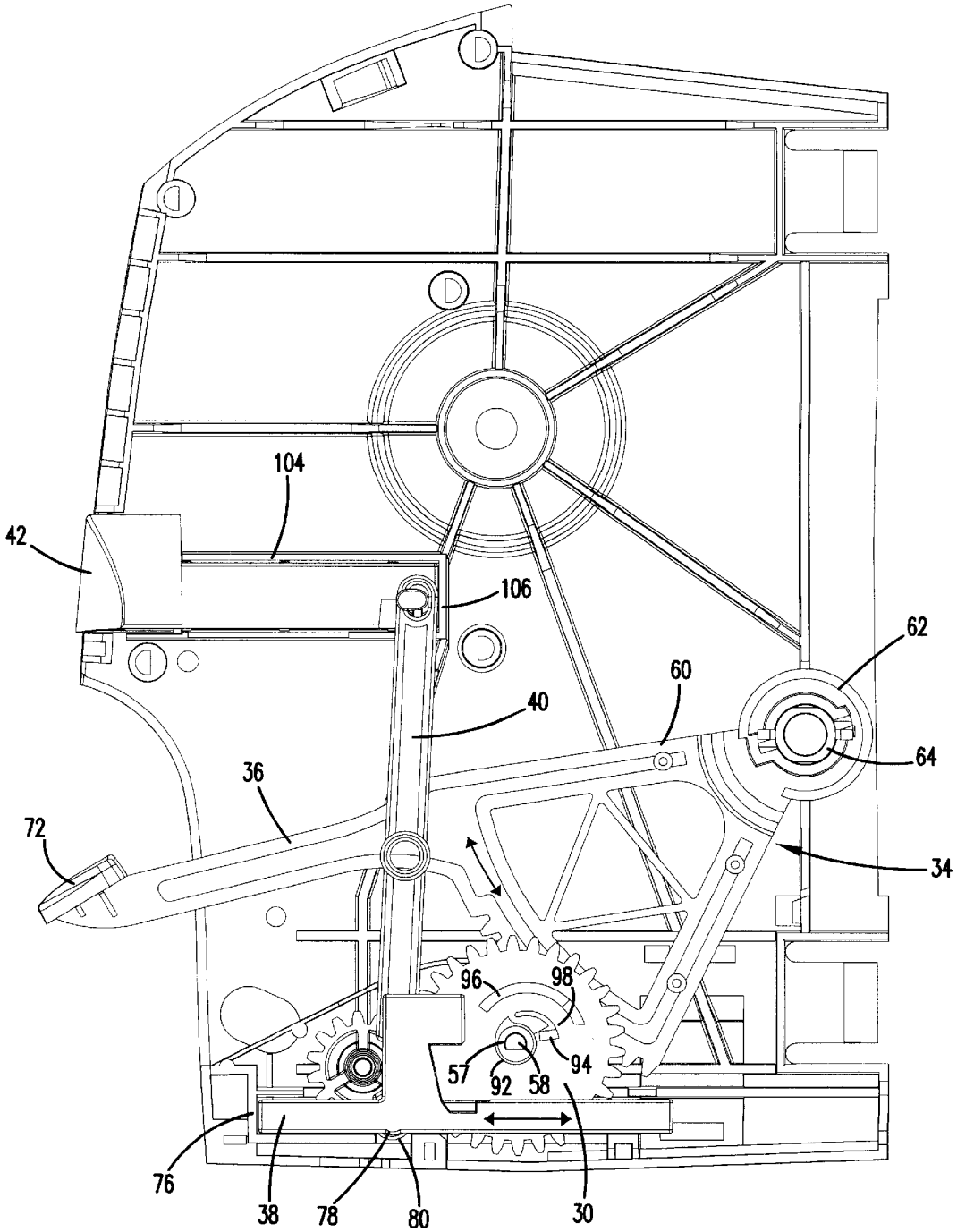
FIG. 6 is a side view of the dispensing mechanism and the metering mechanism shown in FIG. 5.
Figure 7:
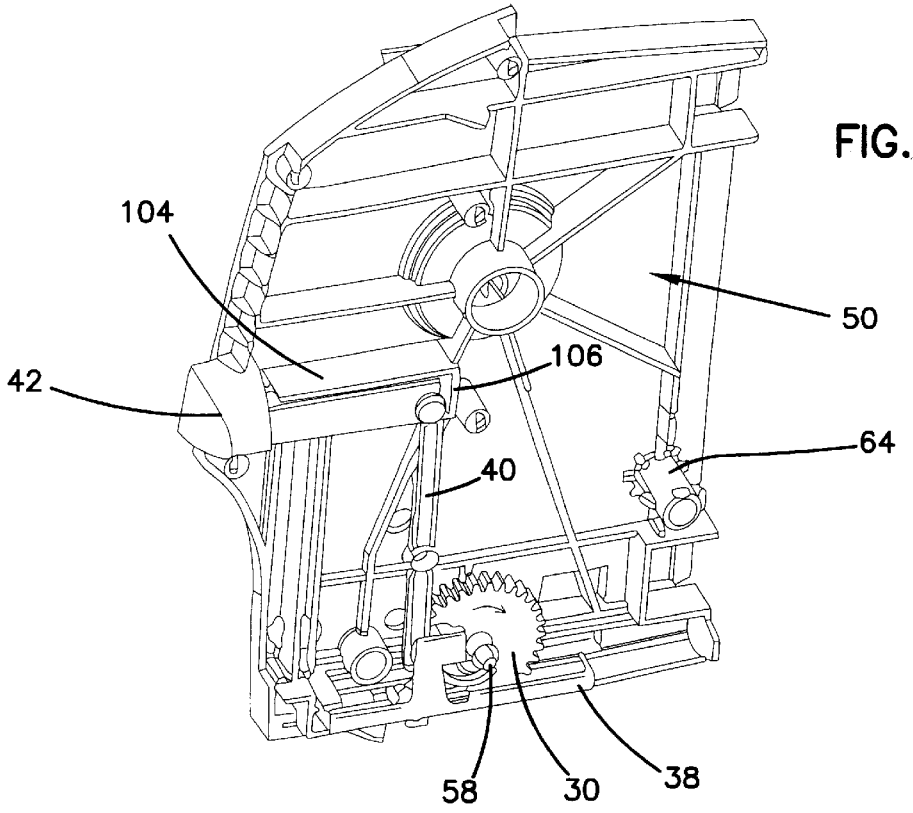
FIG. 7 is a perspective view of the metering mechanism with the metering mechanism being returned to the engaged position.
Figure 8:
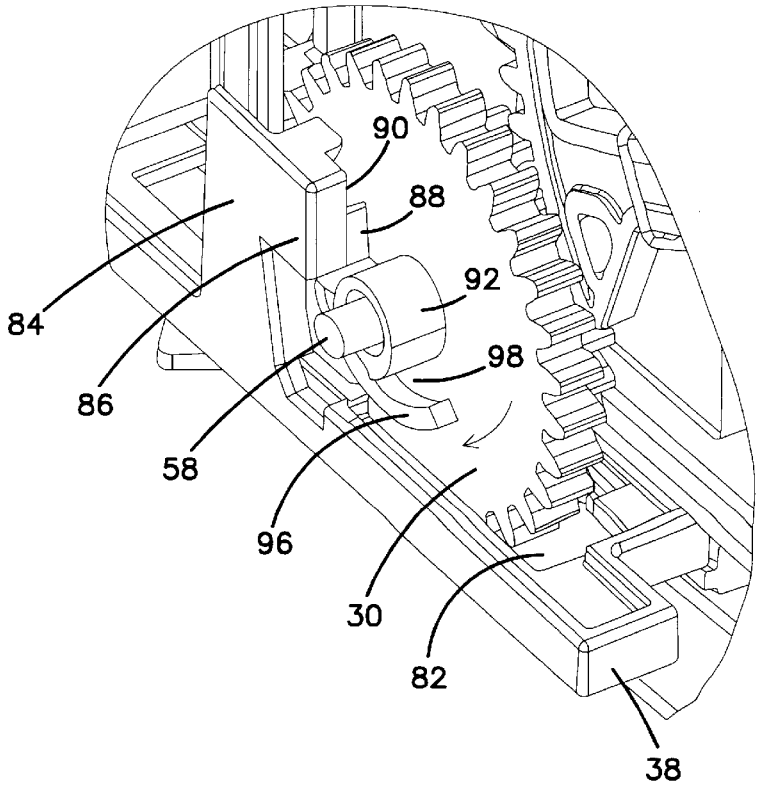
FIG. 8 is a close-up view of elements of the metering mechanism and the dispensing gear.

More particularly, the side of the dispensing gear 30 that faces the drive 30 gear 32 is formed with a central boss 56 that receives therein a conventional, uni-directional clutch bearing 57, best seen in FIG. 6. A shaft 58, shown in FIGS. 7 and 8, is fixed to the drive gear 32 and extends through the clutch bearing 57, with a free end thereof projecting past the dispensing gear 30 and a fixed end thereof being fixed within a boss 59 that is integrally formed on the side of the drive gear 32 opposite the dispensing gear 30. The free end is rotatably received within a corresponding sleeve (not shown) provided on the side housing portion 18, while the boss 59 is rotatably supported within a sleeve (not shown) provided on the panel 50. Thus, the free end of the shaft 58 and the boss 59 combine to rotatably support the dispensing gear 30 and the drive gear 32 assembly.

The drive gear 32 is driven by the arcuate gear segment 34 that is engaged therewith. The gear segment 34 is formed by a body 60 having a pivot mount 62 at one end thereof that is disposed around a pivot stub shaft 64 mounted on the panel 50, whereby the gear segment 34 is pivotally mounted on the dispenser 10 for pivoting movements about the axis of the pivot stub shaft 64. The body 60 further includes an arcuate edge 66 that is provided with gear teeth 68 that mesh with the drive gear 32, whereby pivoting movements of the gear segment 34 result in rotation of the drive gear 32.

Projecting from the arcuate edge 66 of the gear segment 34 is the dispensing lever 36 having an actuating end 72. The lever 36 extends through a slot 74 formed in the front of the housing 12 so that the actuating end 72 thereof is accessible from outside the housing 12 to enable a user to actuate the dispensing mechanism 20. It is preferred that the gear segment 34 be biased in a counterclockwise direction (viewed from FIG. 4) whereby the dispensing lever 36 and actuation end 72 are biased to the upper end of the slot 74 as shown in FIG. 1. Preferably, the gear segment 34 is biased by a coil spring disposed around the stub shaft 64, with the spring having one end engaged with the panel 50 and its other end engaged with the gear segment 34. However, other biasing mechanisms known in the art could be used as well.

Figure 4:
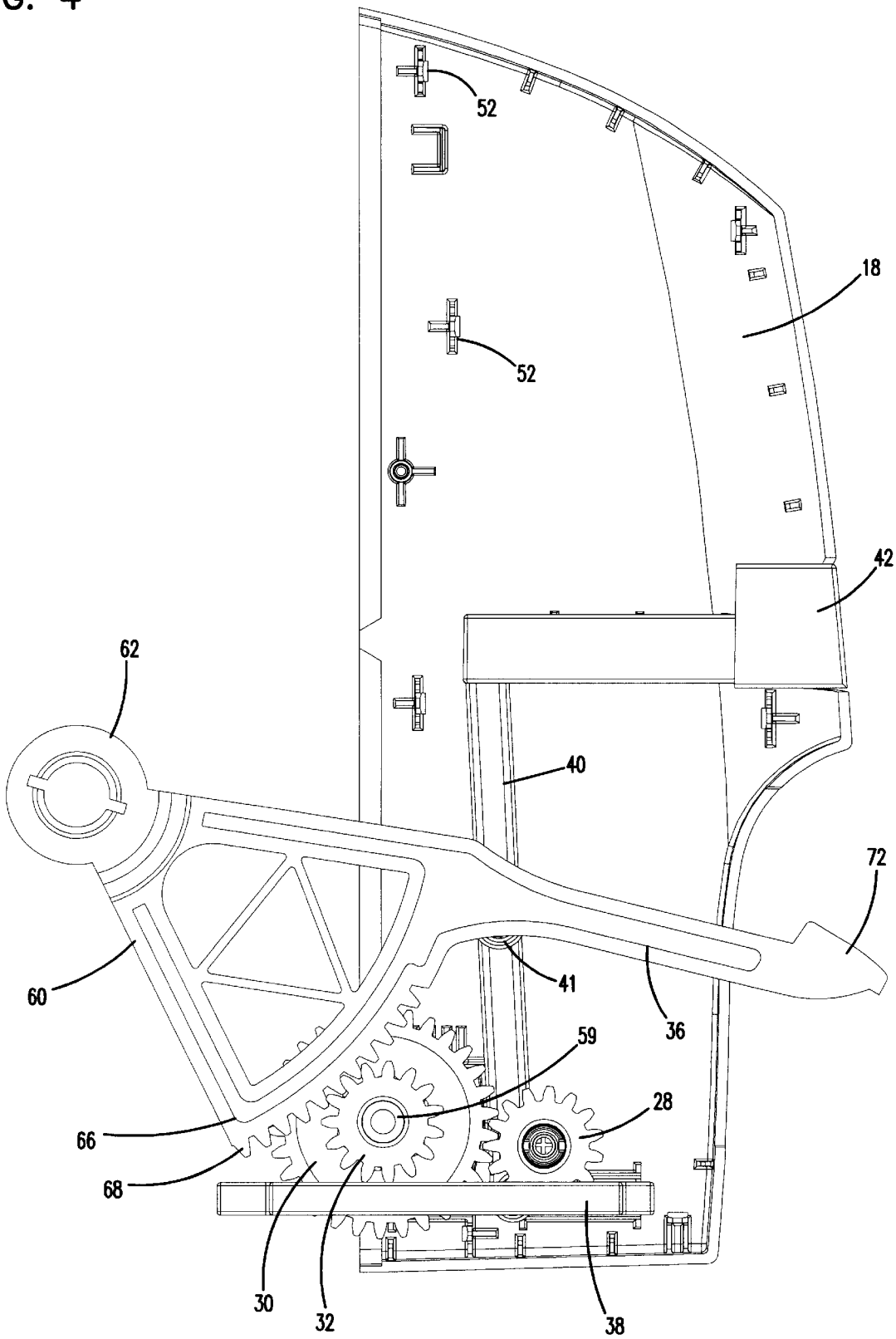
FIG. 4 is a side view of the dispensing mechanism and the metering mechanism shown in FIG. 3.

As should be apparent from the description so far, and with reference to FIG. 4, when a user pulls/pushes down the actuation end 72 of the lever 36 (i.e. the dispensing stroke), the gear segment 34 is rotated in a clockwise direction, thereby rotating the drive gear 32 in the counterclockwise direction. The clutch bearing 57 causes the dispensing gear 30 to be simultaneously rotated in the clockwise direction, which causes rotation of the pinion gear 28 in the counterclockwise direction. Since the pinion gear 28 is drivingly connected to the drive roll 24, the drive roll 24 is driven to dispense paper towel from the dispenser 10.

Once the dispensing lever 36 is released by the user, the gear segment 34 is biased in the counterclockwise direction back to its initial position, so that the dispensing lever 36 and actuation end 72 are returned to the top of the slot 74 (i.e. the return stroke). As the gear segment 34 returns to its initial position, the drive gear 32 is rotated thereby in the clockwise direction. However, the clutch bearing 57 prevents the rotation of the drive gear 32 from rotating the dispensing gear 30 during the return stroke, which prevents the drive roll 24 from being driven in a direction that would pull paper towel into the dispenser 10.

The metering mechanism 22 will now be described with particular reference to FIGS. 5–8. The metering bar 38 is slidably disposed within a channel that is defined by the side housing portion 18 and the panel 50, whereby the metering bar 38 is slideable back and forth, as shown by the arrows in FIGS. 5 and 6, along a generally linear path. FIG. 6 illustrates the metering bar 38 at its most forward position relative to the housing 12, with any further movement of the bar 38 toward the front of the housing 12 prevented by a wall 76 formed on the panel 50. FIG. 7 illustrates the metering bar 38 at its most rearward position.

Figure 5:
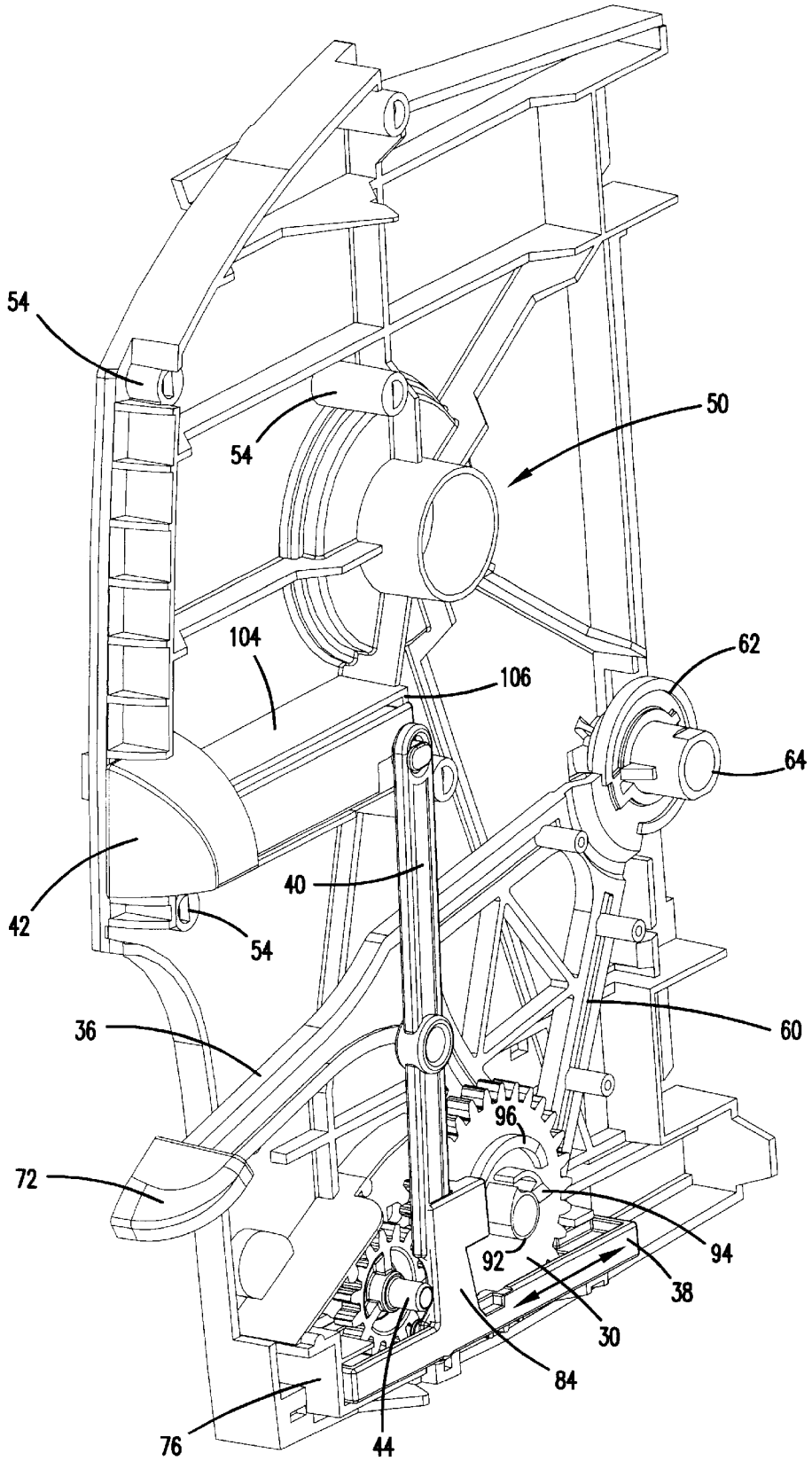
FIG. 5 is a right-side perspective view of the dispensing mechanism and the metering mechanism in relation to an interior panel of the dispenser housing, with the metering mechanism being disengaged to permit towel dispense.

As is evident from FIGS. 5 and 7–8, the metering bar 38 is recessed and includes a slot 82 in which the lower portions of the gears 28, 30 are disposed. The slot 82 is wide enough to allow the gears 28, 30 to rotate freely and long enough to avoid interference with the gears in all positions of the metering bar 38.

Figure 9:
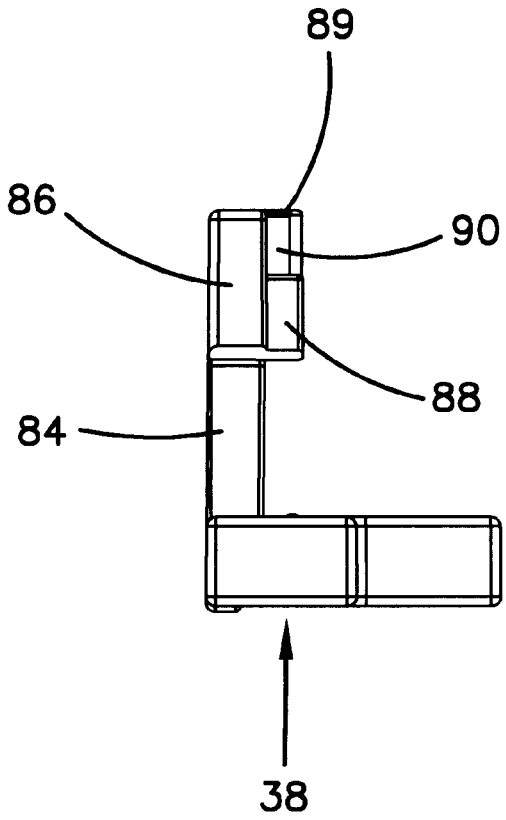
FIG. 9 is an end view of the metering bar.
Figure 10:
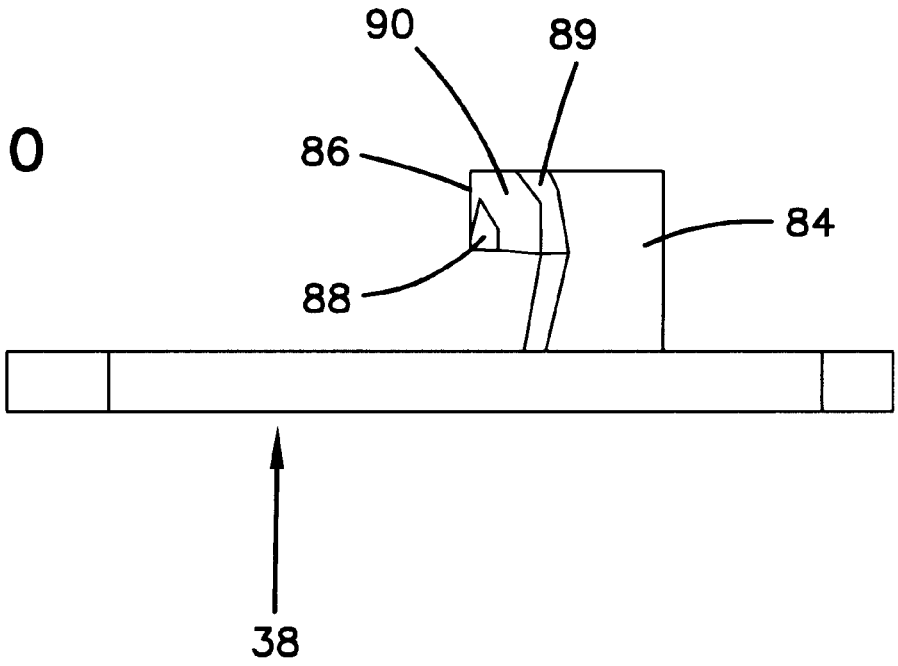
FIG. 10 is a back-side view of the metering bar illustrating the cam follower channel formed therein.

With reference to FIGS. 9 and 10, an arm 84 projects upwardly from the top of the metering bar 38 on the side of the dispensing gear 30 that is opposite from the drive gear 32. The arm 84 includes a stop piece 86 at the top thereof that projects rearwardly toward the shaft 58. A pair of projections 88, 89 are connected to the stop piece 86 and extend toward the side face of the dispensing gear 30, and define therebetween a cam follower channel 90.

A stub 92 is fixed to the dispensing gear 30 around the central axis thereof. The stub 92 includes a stop 94 projecting therefrom that is designed to engage with the stop piece 86, at a certain position of the metering bar 38, and thereby prevent further rotation of the dispensing gear 30, as shown in FIG. 8. Further, an arcuate cam 96 is fixed to the face of the dispensing gear 30 and rotates therewith. The cam 96 and the cam channel 90 are sized to enable the cam 96 to fit within the cam channel 90 of the metering bar 38 for a purpose to be discussed below. As evident from FIG. 6, the front of the cam 96 (i.e. adjacent the stop 94) has a larger radius than the end thereof, with the cam 96 decreasing in radius in a continuous fashion therebetween.

The metering bar 38 and dispensing gear 30 interact as follows. When the metering bar 38 is at its rearward position shown in FIGS. 7 and 8, the stop piece 86 is positioned to be engaged by the stop 94 on the dispensing gear 30, thereby preventing rotation of the gear 30 and thus preventing dispensing of paper towel. To commence dispensing, the metering bar 38 must be actuated forward, toward the front of the housing 12, to its forward position. At this position, the stop 94 does not engage the stop piece 86, and the cam 96 is positioned at the entrance of the cam channel 90 to permit the gear 30 to rotate upon actuation of the dispensing lever 36. As the dispensing gear 30 starts to rotate, the cam 96 enters the cam channel 90 and travels along the channel 90. As rotation of the gear 30 continues, the cam 96 continues traveling along the cam channel 90, which causes the metering bar 38 to be forced backward to its rearward position, due to the decreasing radius of the cam 96. Thus, the cam 96 and cam channel 90 interact together such that the rotation of the dispensing gear 30 forces the metering bar 38 back to its rearward position.

Once the cam 96 exits the cam channel 90, the metering bar 38 is once again at its rearward position with the stop piece 86 in position to engage the stop 94. As described previously, the dispensing gear 30 rotates once for every two dispensing strokes of the lever 36, i.e. the gear completes one-half of a revolution for every stroke of the lever 36. Thus, during the first dispensing stroke of the lever 36, the cam 96 and cam channel 90 cause the metering bar 38 to be forced back to its rearward position, with the dispensing gear 30 being rotated approximately one-half revolution to the position shown in FIG. 6. On the next dispensing stroke, the dispensing gear 30 is again rotated about one-half revolution, until the stop 94 engages the stop piece 86 on the metering bar. At this point, further dispensing strokes of the lever 36 are prevented until the metering bar 38 is again actuated forward to its forward position. This requirement to repeatedly actuate the metering bar 38 makes it inconvenient for users to dispense an excessive amount of paper towel.

To actuate the metering bar 38, the link 40 is pivotally connected thereto at one end, with the link 40 itself being pivotally mounted, proximate the center thereof, on a pin 41 projecting from the side housing portion 18. The actuation button 42 is generally elongated and is slideably supported in a housing 104 formed on the panel 50. One end of the button 42 is pivotally connected to the end of the link 40, while the opposite end of the button 42 extends through a suitably shaped hole at the front of the housing 12 such that the end of the button is accessible from the front of the housing 12, as shown in FIG. 1, to permit actuation thereof. The button 42 moves within the housing 104 along a linear path that is generally parallel to, but spaced from, the linear path of movement of the metering bar 38. Further, due to the link 40, the direction of movement of the button 42 is opposite the movement of the metering bar 38. Thus, when the button 42 is pushed inward by a user, the metering bar 38 is forced in the opposite direction toward its forward position. FIGS. 5 and 6 also illustrate the housing 104 as having a rear wall 106 that acts as a stop for the button 42 to limit how far the button can be pushed inward.

The button 42 is moveable between a first position, in which the end thereof projects from the front of the housing and the metering bar 38 is at its rearward position, and a second position, in which the end thereof is generally flush with the housing, as shown in FIG. 4 and in which the metering bar is at its forward position. Thus, to begin dispensing towel, the button 42 is pushed inward until it is generally flush with the housing, thereby moving the metering bar 38 to its forward position. During the first dispensing stroke of the lever 36, the bar 38 is forced back to its rearward position which forces the button 42 in the opposite direction such that the end of the button 42 again projects outward from the front of the housing ready for another actuation.

It should further be apparent from the description that the button 42 cannot be held in while actuating the dispensing lever 36, as engagement between the cam 96 and the cam channel 90 will prevent rotation of the dispensing gear 30 until the button 42 is released.

The inventors have discovered that the arrangement of the metering bar 38, link 40 and button 42 utilized with the invention described herein renders the dispenser 10 more tamper resistant compared to conventional dispensers. By locating the button 42 vertically above the gears, and utilizing three separate parts (i.e. the bar 38, link 40, button 42) the tampering problem is reduced significantly. In the event that the button 42 is smashed inward with extreme force, the force of the blow is absorbed by the link 40, and by the housing 104 and the rear wall 106. Thus, the likelihood of resulting damage to the gears of the dispensing mechanism 20 as a result of intentional tampering is reduced.

Furthermore, by locating the button 42 vertically above the actuation end 72 of the dispensing lever 36, a more ergonomic design is achieved. Once the button 42 is pushed inward, the user's hand is already located adjacent the actuation end 72 so that the actuation lever 36 is readily actuated. Thus, the locations of the button 42 and actuation end 72 result in a more natural operation of the dispenser 10.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A towel dispenser, comprising:

a housing;

a dispensing mechanism associated with said housing for dispensing towel stored within said housing;

a metering mechanism associated with said housing for metering a length of towel dispensed from said housing;

wherein said metering mechanism includes a metering bar slideably disposed within said housing and selectively engageable with said dispensing mechanism for controlling actuation of said dispensing mechanism, and an actuation button accessible from outside said housing and connected to said metering bar for actuating said metering bar, said actuation button moveable in a direction that is opposite the direction of movement of said metering bar, and a link pivotally supported by said housing and interconnecting said metering bar and said actuation button, said link is pivotally connected to said actuation button and to said metering bar; and wherein said actuation button is moveable in a direction that is parallel to the direction of movement of said metering bar.

2. The towel dispenser according to claim 1, wherein said actuation button and said metering bar are moveable in substantially linear directions.

3. The towel dispenser according to claim 1, wherein said metering mechanism further includes a link pivotally supported within said housing, said actuation button connected to one end of said link and said metering bar connected to the opposite end of said link.

4. The towel dispenser according to claim 1, wherein said dispensing mechanism includes a dispensing lever pivotally supported within said housing, said lever includes an actuating end that projects from said housing, and said actuation button is disposed vertically above said actuating end.

5. The towel dispenser according to claim 4, wherein said housing includes a front side, and said actuation button and said actuating end are accessible from the front side of said housing.

6. The towel dispenser according to claim 1, wherein said dispensing mechanism includes a dispensing gear rotatably supported within said housing, said dispensing gear having a stop disposed thereon, and said metering bar is slideable between a first position at which said stop is engaged with said metering bar thereby preventing rotation of said dispensing gear, and a second position at which said stop is disengaged from said metering bar thereby permitting rotation of said dispensing gear.

7. The towel dispenser according to claim 6, wherein said dispensing gear further includes a cam disposed thereon, said cam is constructed to engage said metering bar when said metering bar is at the second position and force said metering bar back to the first position thereof upon rotation of said dispensing gear.

8. The towel dispenser according to claim 7, wherein said metering bar includes a cam channel formed thereon, and said cam is positioned to engage said cam channel.

9. The towel dispenser according to claim 6, wherein said dispensing mechanism further includes a drive gear in driving engagement with said dispensing gear for rotating said dispensing gear in one direction only, an arcuate gear segment pivotally supported within said housing and in driving engagement with said drive gear, and a dispensing lever connected to said arcuate gear segment.

10. A towel dispenser, comprising:

a housing;

dispensing means for dispensing towel stored within said housing;

metering means for metering a length of towel dispensed from said housing, said metering means including metering bar means for controlling actuation of said dispensing means, actuation means for actuating said metering bar means, and a link pivotally supported by said housing and interconnecting said metering bar means and said actuation means for causing said metering bar means to move in a direction that is opposite a direction of movement of said actuation means said link is pivotally connected to said actuation means and to said metering bar means; and said housing including a first stop positioned to engage said actuation means to thereby limit movement thereof.

11. The towel dispenser according to claim 10, wherein said housing further includes a second stop positioned to engage said metering bar means to thereby limit movement thereof.

12. A towel dispenser, comprising:

a housing;

a dispensing mechanism associated with said housing, said dispensing mechanism constructed to dispense towel stored within said housing;

a metering mechanism associated with said housing, said metering mechanism constructed to meter a length of towel dispensed from said housing;

wherein said metering mechanism includes a metering bar that is slideably supported by said housing for movement relative thereto and is selectively engageable with said dispensing mechanism to control actuation of said dispensing mechanism, an actuation button, and a link pivotally supported by said housing and interconnecting said metering bar and said actuation button, said link is pivotally connected to said actuation button and to said metering bar.

13. The towel dispenser according to claim 12, wherein said actuation button is slideably supported by said housing for movement relative thereto, and said actuation button is moveable in a direction that is parallel to a direction of movement of said metering bar.

14. The towel dispenser according to claim 13, wherein said actuation button and said metering bar are moveable in substantially linear directions.

15. The towel dispenser according to claim 13, wherein the direction of movement of said actuation button is opposite the direction of movement of said metering bar.

16. The towel dispenser according to claim 13, wherein said actuation button is moveable along an axis that is disposed vertically above an axis of movement of said metering bar.

17. The towel dispenser according to claim 12, wherein said dispensing mechanism includes a lever that is pivotally supported by said housing, and said actuation button is dispose vertically above said lever.

* * * * *